United States Patent [19]

Borysiak

[11] 4,284,420

[45] Aug. 18, 1981

[54] ELECTROSTATIC AIR CLEANER WITH SCRAPER CLEANING OF COLLECTOR PLATES

[76] Inventor: Ralph A. Borysiak, 2101 Oak Park Dr., South Bend, Ind. 46617

[21] Appl. No.: 70,014

[22] Filed: Aug. 27, 1979

[51] Int. Cl.[3] ..... B03C 3/12; B03C 3/74

[52] U.S. Cl. ..... 55/114; 55/121; 55/138; 55/143; 55/145

[58] Field of Search ..... 55/13, 109, 113, 114, 55/121, 136, 137, 138, 143, 145, 150

[56] References Cited

U.S. PATENT DOCUMENTS

| | | | |
|---|---|---|---|
| 1,394,771 | 10/1921 | Kennard | 55/114 |
| 2,631,687 | 3/1953 | Dohrer | 55/114 |
| 3,540,191 | 11/1970 | Herman | 55/145 |
| 3,616,608 | 11/1971 | Steuernagel et al. | 55/150 |

FOREIGN PATENT DOCUMENTS

| | | | |
|---|---|---|---|
| 484892 | 8/1923 | Fed. Rep. of Germany | 55/121 |
| 1028538 | 4/1958 | Fed. Rep. of Germany | 55/150 |
| 713691 | 10/1931 | France | 55/121 |
| 959655 | 6/1964 | United Kingdom | 55/113 |
| 962773 | 7/1964 | United Kingdom | 55/114 |

*Primary Examiner*—David L. Lacey
*Attorney, Agent, or Firm*—Oltsch, Knoblock & Hall

[57] ABSTRACT

An electrostatic air cleaner wherein the collector plates are uniquely constructed and are thus adapted for cleaning by a scraper. One embodiment uses two separate base members each having multiple spaced plates projecting perpendicularly therefrom. The base members are spaced with each plate of one base member being interposed between and spaced from adjacent plates of the other base member. The base members are shiftable between a use position and a cleaning position. Scrapers are mounted on each base and engage plates mounted on the other base member whereby shifting of the base members from their use position to cleaning position draws scrapers along both sets of plates to clean debris therefrom. Another embodiment includes two spaced apart parallel shafts, each of which carries multiple spaced circular discs. The discs of one shaft are interposed between and spaced from those of the other shaft. The shafts are journaled to rotate the discs through an air stream where they collect debris. Scrapers with disc-receiving slots remove debris from the discs when the discs are rotated.

14 Claims, 6 Drawing Figures

ELECTROSTATIC AIR CLEANER WITH SCRAPER CLEANING OF COLLECTOR PLATES

BACKGROUND AND SUMMARY OF THE INVENTION

This invention relates to electrostatic air cleaners and has application to both single and multi-stage air cleaners.

Electrostatic air cleaners are used to remove particulate matter such as smoke, oil mist, and pollen from the air circulated in dwellings, factories, and other structures. Generally, they may be characterized as a group of spaced electrically charged plates between which a stream of air is directed. Alternate plates of the group are electrically charged oppositely so as to establish a potential difference between adjacent plates. Particulate matter carried into the plate group by an airstream is electrically charged by its passage in proximity to a charged plate of the stack and is then attracted and adheres to one of the oppositely charged plates and is thus removed from the air which is then recirculated in the structure. The construction so far described is generally referred to as a single stage precipitator.

To more effectively accomplish charging of the particulates, some single stage devices have one set of plates positioned further upstream of the air flow than is the oppositely charged set. Thus, the particulate matter enters first a region of electrostatic potential between the like charged plates and is charged before entering a region between the oppositely charged plates to there be removed from the airstream.

Multi-stage precipitators carry the concept just described a step further by having a grid of wires or plates, referred to as an ionizer grid, upstream of the collector plates. The ionizer grid may be charged to an electrical potential different from, and preferably higher than, that of the collector plates to more effectively charge the particulates. Precipitators with one plate group and one ionizer grid are referred to as being of two-stage type. Other multi-stage precipitators are constructed using various combinations of ionizer grids and plate groups through which an airstream passes in succession.

Because collected and adhered debris greatly reduces a precipitator's efficiency and effectiveness, it must be removed periodically. The cleaning of electrostatic air cleaners has been a problem because of the close spacing of the plates and the high voltages applied to the closely spaced, oppositely charged plates. Care must be exercised to see that the plates are cleaned effectively and are not electrically shorted together or to a ground. For this reason, some devices require periodic shutdown and disassembly so that the plate groups can be removed for washing. Other devices are rappers or shakers which strike or vibrate the plates to loosen collected debris and cause it to fall from the plates to the bottom of a housing where it collects for periodic removal. Other devices use an intermittently applied water film which flows over the collector plates while electrically uncharged to wash away collected debris. All of these cleaning methods suffer from disadvantages. Some do not do a good job of cleaning, others are complex and expensive, others are inconvenient and reduce the air cleaner's effective working time and increase maintenance requirements.

In one form of the air cleaner of this invention, each of two separate base members mounts a set of multiple spaced collector plates which project generally perpendicularly therefrom. The collector plates are preferably of similar length and shape. The base members are spaced apart with the plates of each projecting toward the other base and are shiftable between a use position and a cleaning position. In the use position the plates are interposed and equispaced. In the cleaning position the base members are further spaced apart and the plates are at least partly withdrawn from interposed relationship. The spacing of the bases in their use position is chosen to provide a space to receive a pair of slotted scraper plates, each mounted adjacent to a base and adapted to scrape the plates of the adjacent base when the base members are shifted relative to the scraper plates.

In two or multi-stage precipitators, a scraper may scrape the wires, or the plates, or other elements of the ionizer grid.

Another embodiment of the invention includes two spaced parallel shafts, each of which carries multiple radially projecting spaced circular discs. The shafts are journaled and so spaced and positioned that the discs of each shaft are interposed between those of the other shaft and spaced from adjacent discs and from the opposite shaft. An electrical charge is applied to the discs so as to establish an opposite charge on adjacent discs. An airstream from a structure is directed between the interposed discs. The discs rotate and pass through scrapers which remove accumulated debris. As previously described, an ionizer grid may be positioned in the airstream in advance of the discs to effectively charge the particulates.

It is an object of this invention to provide a uniquely constructed air cleaner with means for scraping clean the collector plates of the device.

Another object is to provide an air cleaner wherein the ionizer grid is provided with scrapers for cleaning thereof.

Another object is to provide an air cleaner which is efficient and economical.

Another object is to provide an air cleaner which may be quickly cleaned.

Other objects will be apparent from the following specification.

DETAILED DESCRIPTION OF THE PREFERRED EMBODIMENTS

The preferred embodiments illustrated are not intended to be exhaustive, nor to limit the invention of the precise forms disclosed. They are chosen and described to illustrate the principles, application, and practical use of the invention and to thereby enable others skilled in the art to utilize the invention.

Figure 1:
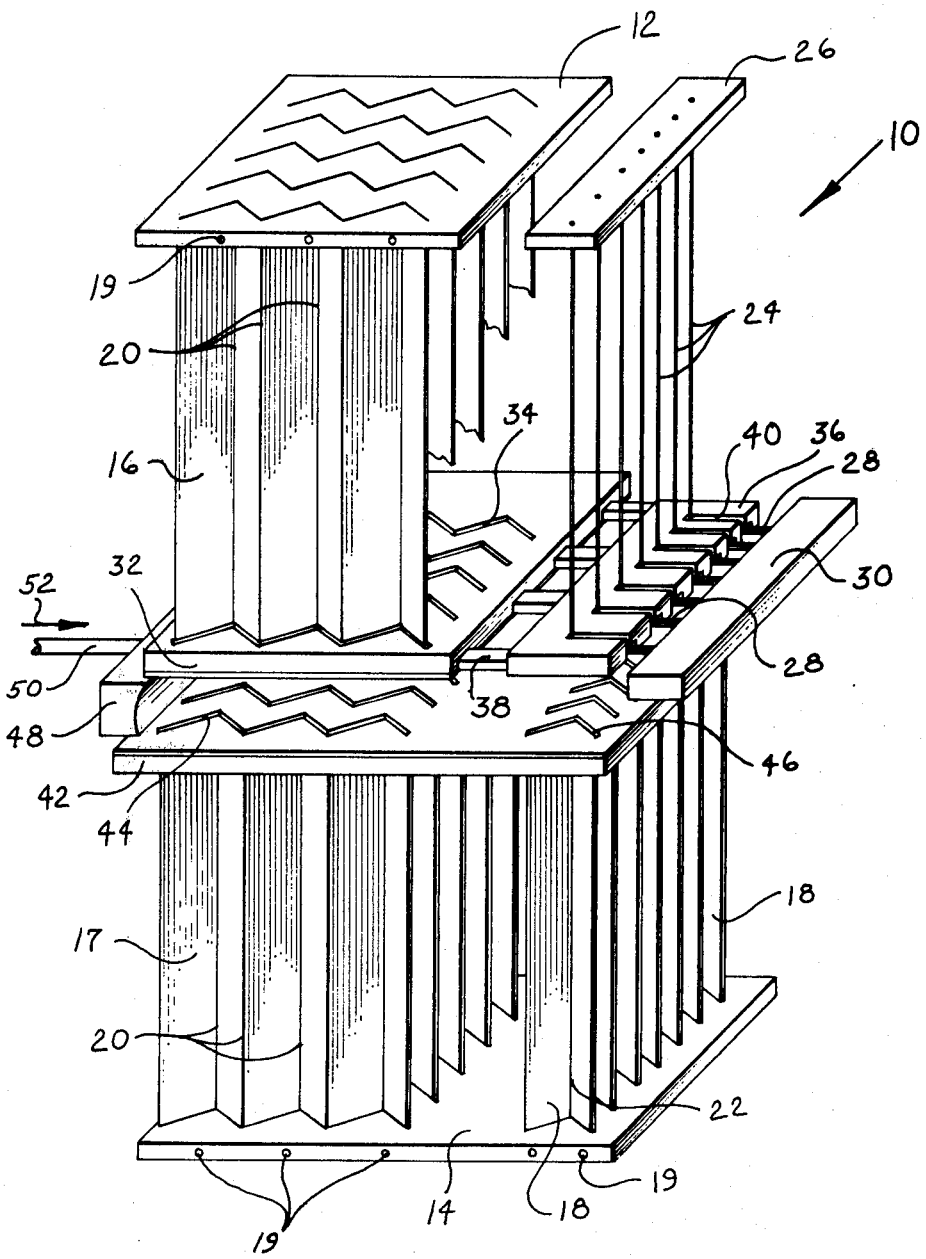
FIG. 1 is a perspective view of one embodiment of my novel air cleaner in plate-cleaning position.
Figure 2:
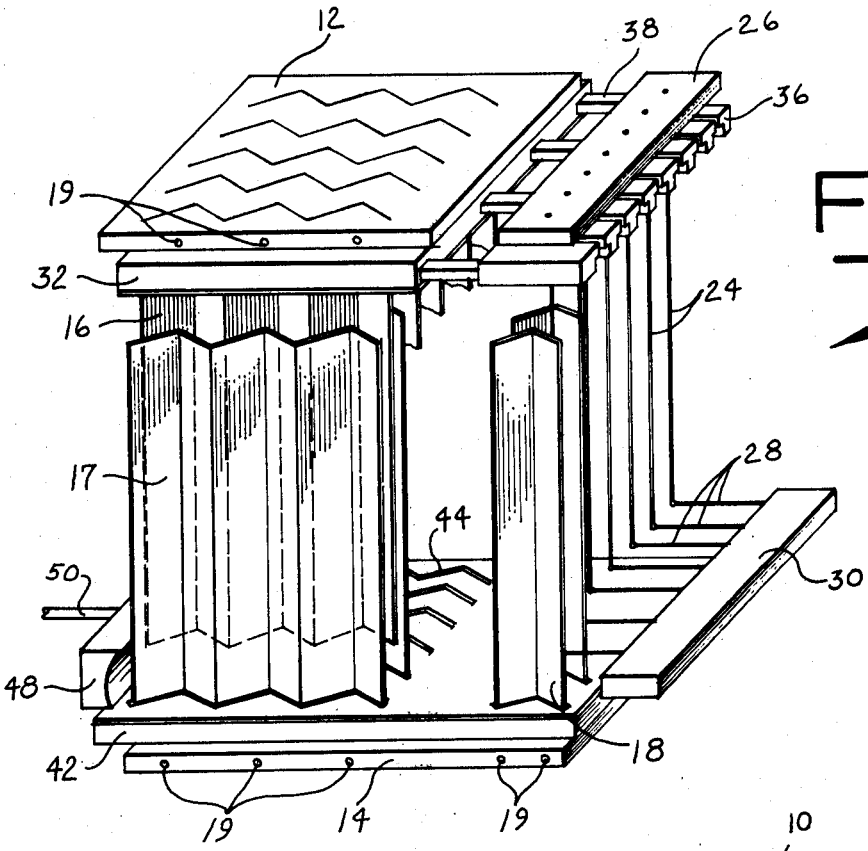
FIG. 2 is a perspective view of the novel air cleaner in use position.
Figure 3:
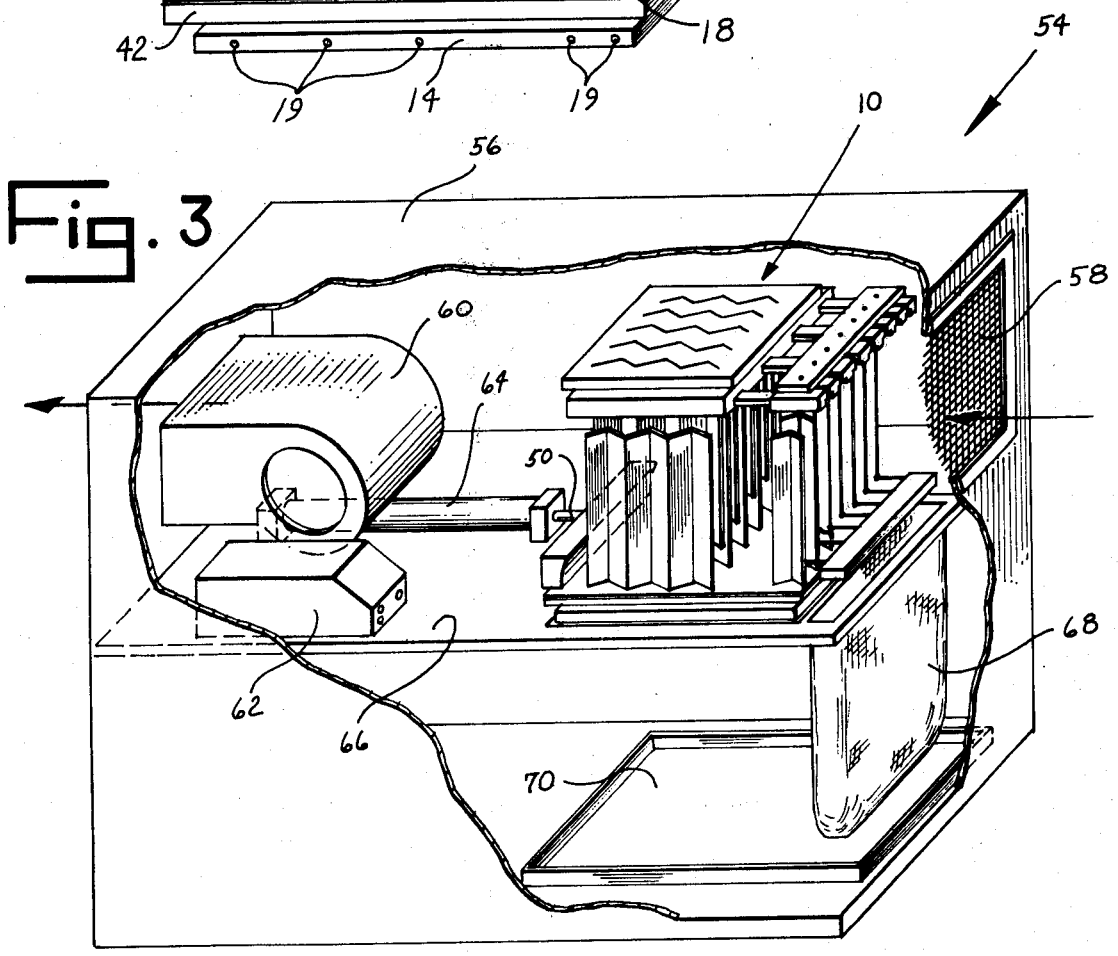
FIG. 3 is a perspective view of an air cleaner of this invention mounted in a housing and with parts broken away for purposes of illustration.

With reference to FIGS. 1–3 of the drawings, the number 10 designates a two stage air cleaner according to this invention which includes a first and a second spaced substantially parallel base plates 12, 14. Base plate 12 carries a plurality of spaced apart parallel collector plates 16, which project perpendicularly therefrom, and base plate 14 carries spaced complementary collector plates 17. Base plate 14 also carries a plurality of spaced apart parallel ionizer plates 18 which project from the base 14 parallel to and spaced from the collector plates 17. Collector plates 16 and 17 preferably have a series of oppositely disposed parallel bends 20. Ionizer plates 18 are preferably bent at 22 intermediate their width to angle form in cross section. Plates 16, 17, and 18, are secured in fixed relation to base plates 12, 14, as by means of tie rods 19 which pass through holes in the base plates which intersect plate receiving slots in said base plates. Openings in the margins of the plates 16–18 received in said slots receive the rods 19. A number of parallel ionizer wires 24 are tensioned between an upper support member 26 and arms 28 which project from a lower support member 30.

A first scraper plate 32 is slidable relative to the collector plate 16 which project from base 12 and has slots or openings 34 therein which closely fit the plates 16 and through which the plates 16 pass. A wire scraper 36 is carried by scraper 32, as by arms 38. Wire scraper 36 has openings 40 therein which closely fit the ionizer wires 24 and through which the wires 24 pass. A second scraper plate 42 is slidable relative to the collector plates 17 which project from base 14. Scraper plate 42 has openings 44 therein which closely fit the plates 17, and through which the plates 17 pass. Scraper 42 also includes angled openings 46 which closely fit the ionizer plates 18 and through which the plates 18 pass. Top plate 12 and scraper plate 42 are connected in selected spaced relation and bottom plate 14 and scraper plate 32 are connected in selected spaced relation. A fourth scraper 48 is interposed between the scraper plates 32 and 42 and is adapted for transverse movement across the top surface of scraper plate 42 when the parts are in the cleaning position shown in FIG. 1, as by an actuator 64 (shown in FIG. 3) having a guide rod 50, shiftable in the direction of the arrow 52. Alternatively, scrapers 32, 42, and 36, may carry scraper blades (not shown) which are closely fitted to their cooperating part and which may be replaced when they become worn. The spacing between scraper plate 32 and base 14 and between scraper plate 42 and base 12 is maintained substantially constant by means (not shown) which may include spacer rods, guides, and other elements designed to maintain the requisite spacing between the bases and scrapers. Any suitable means (not shown) may guide the bases 12, 14 for movement relative to one another. Note that in the cleaning position collector plates 17 terminate below the top surface of scraper plate 42 and collector plates 16 terminate above the bottom surface of scraper plate 32.

FIG. 2 illustrates the air cleaner in use position. Scraper plate 32 is positioned adjacent to base 12 and scraper plate 42 is positioned adjacent to base 14. The collector plates 16 and 17 of the two bases are substantially fully interposed and substantially uniformly spaced apart. The ionizer plates 18 and wires 24 are also interposed and spaced apart with the wire scraper 36 carried by scraper plate 32 being adjacent upper wire support member 26.

FIG. 3 illustrates a typical encased elctrostatic precipitator 54 constructed according to this invention. The precipitator preferably includes a housing 56 having an air inlet opening 58 and enclosing an air cleaner 10, a fan 60, a power supply and control unit 62, and an actuator 64. A horizontal partition 66 below the air cleaner 10 supports a depending debris receptacle 68, with a drip tray 70 below. It will be understood that precipitator 54 and air cleaner 10 may be associated with a furnace or air conditioner unit, which unit will have a fan, plenum chambers, duct work, and other apparatus (not shown) designed to circulate the air in a structure through the furnace, or air conditioner, and through the air cleaner 10 before returning it to the structure.

Figure 6:
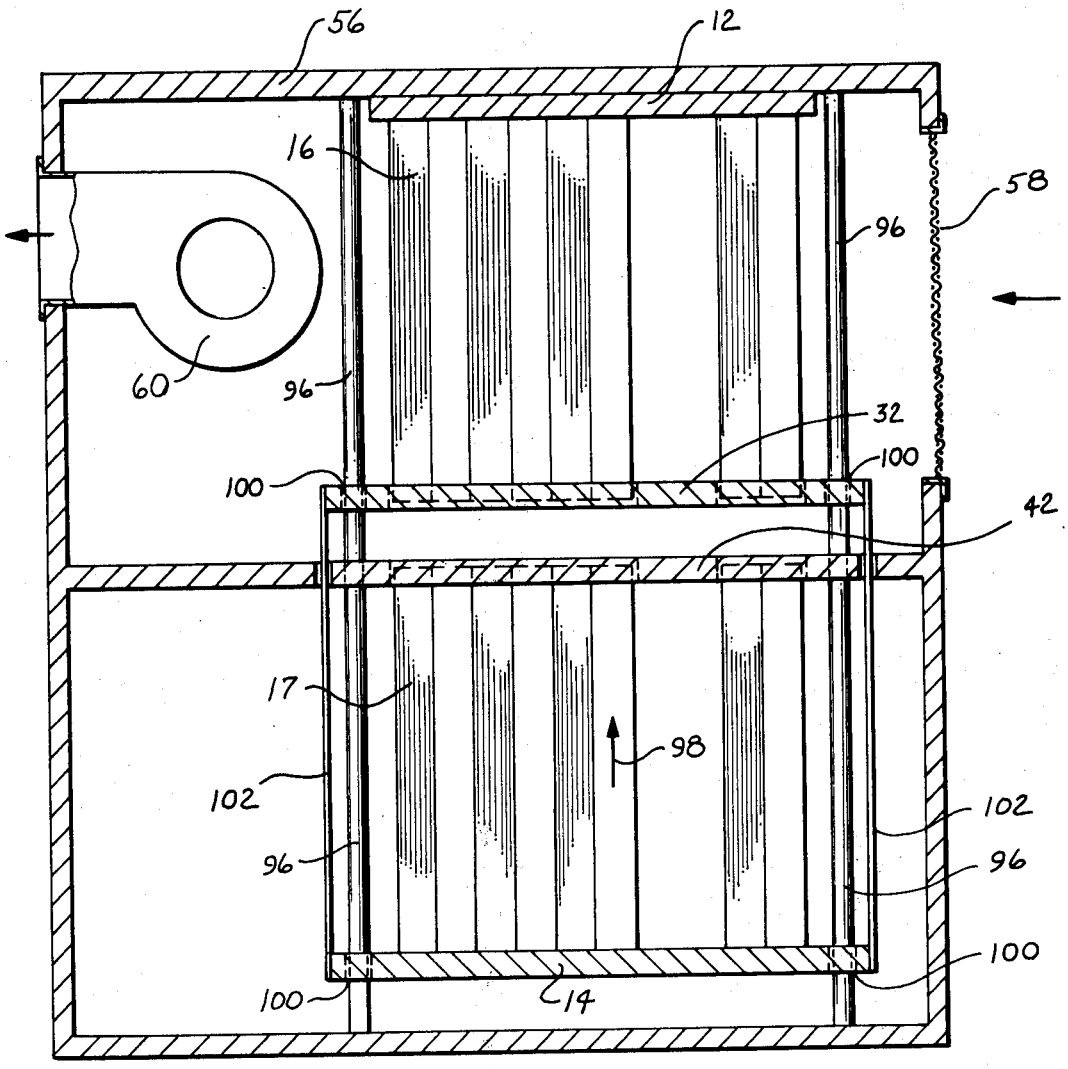
FIG. 6 is a diagrammatic representation of the FIGS. 1–3 embodiment of my invention.

FIG. 6 diagrammatically illustrates the relationship between the bases, plates, and scrapers of the preferred embodiment of FIGS. 1–3, and one means providing for their relative movement. The air cleaner is illustrated in cleaning position. Base plate 12 and scraper 42 are preferably secured to housing 56 and are thus substantially fixed relative to one another. Base plate 14 and scraper 32 slide along guide rods 96, as represented by arrows 98, which pass through closely fitted openings 100 in the base plate and scraper and span the interior of housing 56 parallel to collector plates 16, 17. Tie members or rods 102 connect base plate 14 and scraper 32 in a fixed spaced relation for movement along guide rods 96. Thus, movement of base plate 14, as indicated by arrows 98, toward abutment with scraper 42, slides plates 17 through the openings 44 in scraper 42, slides scraper 32 upwardly along plates 16 which project through the openings 34 thereof, and interposes collector plate groups 16, 17. The spacing between scraper 32 and base plate 14 is preferably the same as that between scraper 42 and base plate 12. Thus, in the use position, base 12 and scraper 32 are adjacent and base 14 and scraper 42 are adjacent.

It will be understood that the embodiment illustrated is not intended to be exhaustive. Those skilled in the art will perceive many variations of this invention. For example, scrapers 32, 42 can be secured in fixed relation with plates 16, 17 inserted therethrough to an interposed use position. Relative movement of a plate group and scraper could be accomplished in this embodiment by sliding a plate group out of interposed relation with the other plate group, thus drawing the plates of the group through the scraper. The scrapers and plate groups, in this embodiment, would preferably not use a tie member 102 and the plate groups 16, 17 preferably would be independent of each other for movement relative to their respective scrapers.

Figure 4:
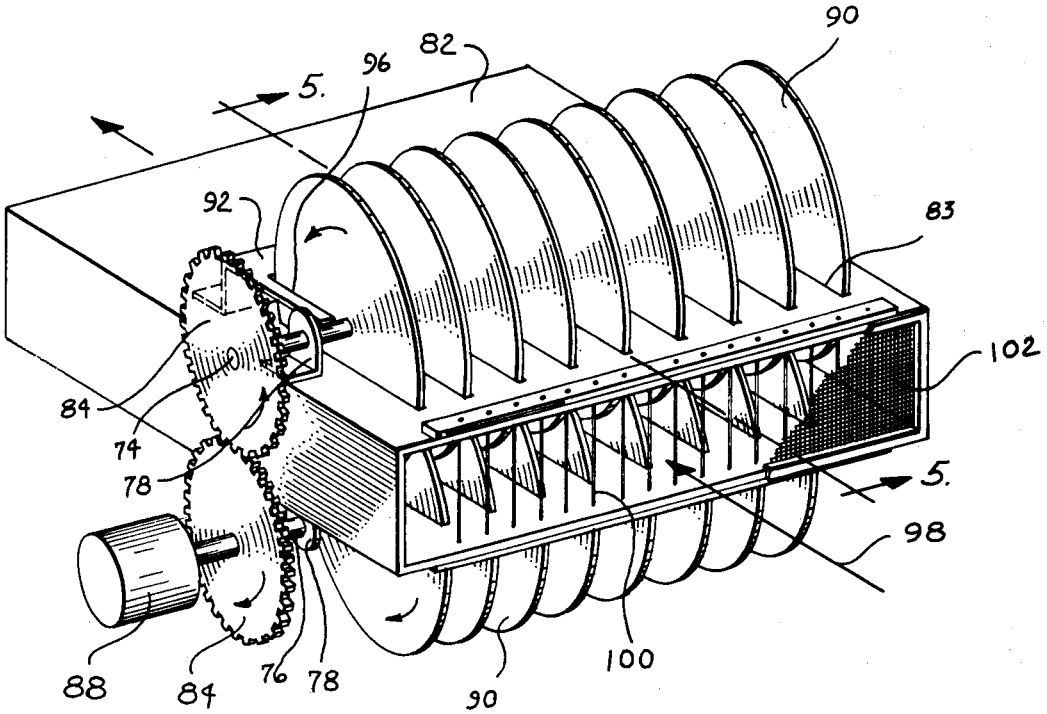
FIG. 4 is a perspective view of another embodiment of the invention.
Figure 5:
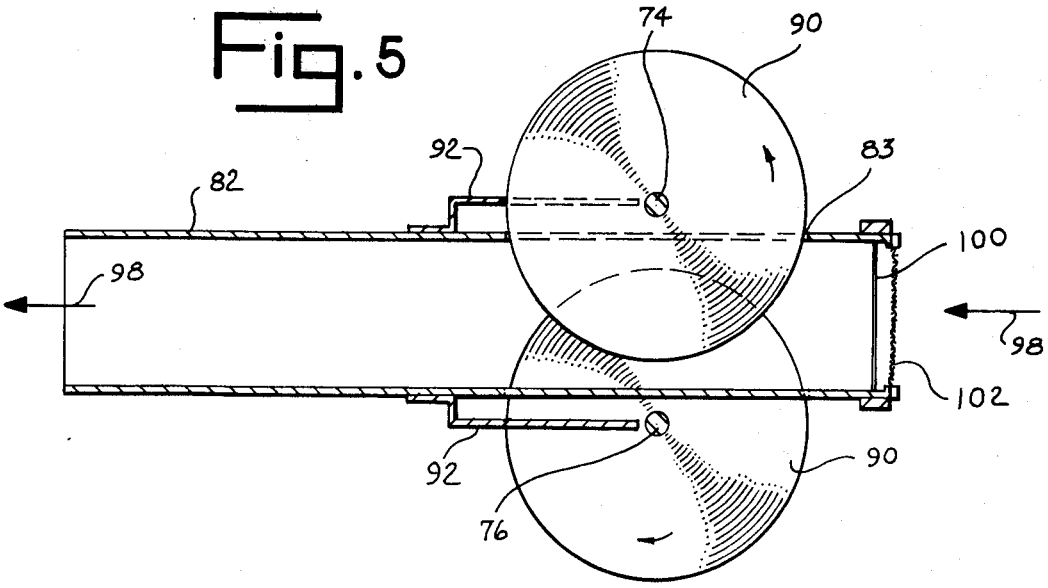
FIG. 5 is a sectional view taken along line 5—5 of FIG. 4.

FIGS. 4, 5, illustrate another embodiment of this invention. This embodiment includes two spaced parallel shafts 74, 76 which are journaled for rotation in brackets 78, attached to air duct 82. A pair of meshing spur gears 84 mounted on said shafts and driven by a motor 88 rotate the shafts 74, 76. Shafts 74, 76, each carry spaced, radially projecting discs 90 which pass through slots 83 of duct 82 and are interposed within the duct, are spaced apart, and are analogous in function to the collector plates of the first embodiment. Scrapers 92 are mounted on duct 82 and are slotted to project adjacent to the opposite faces of discs 90, at least from the edges of discs 90 to points adjacent the shafts 74, 76. Scraper slots 96 are closely fitted to the faces of the discs 90. Alternatively, scrapers 92 may comprise carriers mounting scraper blades (not shown) which are closely fitted to the discs 90 and which are replaceable. Duct 82 is adapted to receive and pass a stream of air (represented by arrows 98) from a structure. An ionizer grid of wires 100 may be located upstream of the discs 90, also, a screen 102 may span the duct in a position to contact air flowing toward disc 90.

It will be understood that the discs 90 and wires 100 are adapted to be electrically charged and to be insulated from duct 82, and, in the case of discs 90, from each other.

The user of the air cleaner of FIG. 1 involves its placement in communication with means for circulating air in a structure and to and through the cleaner. Connections to a source of electrical potential must also be provided so as to oppositely charge the collector plates 16 and 17 and also, where provided, the wires 24, and plates 18 of the ionizer grid. When the air cleaner is in its use position and electrically charged, and air is moved through the device, foreign particulate matter such as smoke, oil mist, pollen, paint mist, and other such matter will be electrically charged and subsequently removed from the air by the electrostatic forces acting upon the particulates to cause the majority of foreign matter to adhere or deposit on the plates 16, 17. However, in units having an ionizer grid, some material will collect upon the elements of the grid.

When foreign material has collected on the collector plates to an extent requiring cleaning, the parts of the device are shifted from the FIG. 2 use position to the FIG. 1 cleaning position. This shifting draws the scraper plate 32 along the collector plates 16 and draws plates 17, 18 through scraper plate 42. This movement also draws scraper 36 along wires 24. Debris pushed ahead of the advancing scrapers will be pushed to a position between the scrapers to rest on plate 42 as seen in FIG. 1. Scraper 48 then is passed along the top surface of scraper plate 42, removing substantially all of the debris and pushing it beyond the edge of the scraper plate 42, where it may fall into a collecting receptacle (not shown). Because the debris is frequently wet or cohesive, and may not fall from the underside of scraper plate 32 and onto scraper plate 42 by its own weight, it may be necessary to clean the underside of scraper plate 32 simultaneously with cleaning of scraper plate 42 by member 48.

FIG. 3 illustrates one application of the air cleaner and means for collecting the debris pushed over the edge of scraper plate 42 by scraper 48. The receptacle 68 is removable and is provided in a location to catch and accumulate the debris released by member 48. Also, the drip tray 70 may be provided where the particulates include oil mists or other liquid materials which drip from the air cleaner. In this application, the base plate 14 may be positioned below the partition 66 when the air cleaner is in cleaning position.

It will be understood that manual or automated means (not shown) may be provided for moving the bases 12, 14, and associated parts relative one another, and for moving scraper 48. The shifting of air cleaner 10 from use to cleaning position, traverse and return of scraper 48, and shifting of the air cleaner back to use position can be accomplished in a few moments and generally without the need to disassemble the air cleaner.

The use of the embodiment shown in FIGS. 4, 5, is similar to the use of the FIG. 1–3 embodiment with the exception that cleaning of the discs 90 is accomplished by rotation of the discs relative to or through scrapers 92. A variety of housings for the device and means for collecting the debris from scrapers 92 will be obvious to those skilled in the art.

It is to be understood that this invention is not to be limited to the precise form disclosed, but that it may be modified within the scope of the appended claims.

What I claim is:

1. An electrostatic precipitator comprising;

a member defining an air passage, two sets of oppositely electrically charged spaced substantially parallel collector plates, each set having a portion positioned in said member, a base plate mounting the collector plates of each set, plate scraping means cooperating with each set of collector plates, means connecting the base plate of each set with the scraping means cooperating with the other set in selected spaced relation, and means guiding movement of one plate set and its connected scraping means relative to the other plate set and its connected scraping means between a position in which said sets of collector plates are interposed and a position in which said collector plates are spaced apart.

2. In an electrostatic air cleaner having a member defining an air passage and two groups of spaced collector plates adapted to be electrically charged, and having a portion in said member, a first base member having one of said groups of spaced electrically charged collector plates projecting therefrom, a second base member having the other one of said groups of spaced collector plates projecting therefrom and charged to electrical potential opposite the charge of said first group of plates, said base members being spaced apart with the collector plates of each projecting toward, spaced from, and substantially parallel to the other plates, one of said base members being shiftable between a use position in which the collector plates are interposed and a cleaning position in which said plates are withdrawn from interposed relation, scraping means positioned to engage the plates of said first base when said shiftable base member is shifted, and scraping means shiftable along the plates of said second base.

3. The air cleaner of claim 2 wherein said collector plates are removably secured to said base members.

4. The air cleaner of claim 2 wherein said scraping means include a carrier and removable scraper blades.

5. The air cleaner of claim 2, and a third scraper constructed and arranged for transverse movement across the lowermost one of said first named scrapers to remove debris from said lowermost scraper when said collector plates are in said cleaning position, whereby said lowermost scraper is scraped by said third scraper.

6. In combination in an electrostatic air cleaner having a member defining an air passage and two groups of spaced normally interposed relatively shiftable collector plates adapted to be oppositely electrically charged, said groups being normally stationary in interposed relation in said member, an ionizer grid in said member adapted to be electrically charged comprising two oppositely charged groups of normally interposed spaced relatively shiftable ionizer elements parallel to each other and to said collector plates and spaced from said collector plates, scraping means positioned and arranged with respect to said groups of ionizer elements and with said groups of collector plates to scrape said ionizer elements and said groups of collector plates, and means for shifting one group of collector plates, one group of ionizer elements and one scraping means relative to the other group of collector plates, the other group of ionizer elements and the other scraping means.

7. The combination defined in claim 6 wherein said scraping means includes a carrier removably mounting scraper blades.

8. The combination defined in claim 6, and means for connecting said ionizer grid scraping means and collector plate scraping means for simultaneous movement relative to said collector plates and ionizer grid.

9. The combination defined in claim 6, wherein said ionizer grid elements include spaced parallel plates.

10. The combination defined in claim 9, wherein said plates are bent intermediate their width to an angled cross section.

11. In combination in an electrostatic air cleaner having a member defining an air passage and two relatively shiftable groups of spaced collector plates having at least a part positioned in said member and adapted to be oppositely electrically charged and two groups of relatively shiftable ionizer grid elements adapted to be electrically charged and comprising;

a group of spaced parallel wires tensioned parallel to said collector plates between an upper and lower support member, and a group of spaced parallel ionizer plates spaced from and parallel to said wires, one group of said collector plates and said ionizer elements being shiftable relative to the other group of collector plates and ionizer elements between a use position and a cleaning position, said groups of plates and ionizer elements being interposed in use position and being withdrawn from interposed relation in cleaning position, and scraping means positioned relative to each group of collector plates and ionizer plates to remove debris therefrom upon relative shifting of said groups.

12. The combination defined in claim 11, further including scraping means shiftable along said wires.

13. The combination defined in claim 12 wherein at least one of said scraping means includes a carrier removably mounting scraper blades.

14. In an electrostatic air cleaner having a member defining an air passage and two groups of spaced interposed collector plates having at least a part thereof positioned in said member and adapted to be electrically charged, the improvement therein comprising, means connecting together the plates of each group, shiftable means mounting plates of one group for movement between a use position in which the plates of said groups are interposed and a cleaning position in which the plates of said groups are withdrawn to spaced position, and scraping means juxtaposed to the plates of both groups for cleaning said plates of both groups incident to relative movement of said groups between their use and their cleaning positions.

* * * * *